US005732434A

United States Patent [19]

McCarty

[11] Patent Number: 5,732,434

[45] Date of Patent: Mar. 31, 1998

[54] CONTAINER SIDE-WALL SCRAPER

[76] Inventor: Mary K. McCarty, 6250 Highway 12 West, Maple Plain, Minn. 55359

[21] Appl. No.: 746,660

[22] Filed: Nov. 14, 1996

[51] Int. Cl.[6] ..... B08B 9/38; A47L 17/06

[52] U.S. Cl. ..... 15/93.1; 15/236.1; 15/236.06; 15/236.09

[58] Field of Search ..... 15/93.1, 236.09, 15/104.8, 236.06, 236.1, 256.5

[56] References Cited

U.S. PATENT DOCUMENTS

| | | | |
|---|---|---|---|
| 672,554 | 4/1901 | Henkel | 15/93.1 |
| 700,584 | 5/1902 | Vautour | 15/236.06 |
| 1,689,277 | 10/1928 | Burns | 15/236.06 |
| 2,725,884 | 12/1955 | Colby | 15/93.1 |
| 3,942,208 | 3/1976 | Southard, Jr. . | |
| 4,445,245 | 5/1984 | Lu . | |
| 4,469,445 | 9/1984 | Wurtz . | |
| 5,345,642 | 9/1994 | Faldetta . | |
| 5,494,352 | 2/1996 | L'Estrange, Jr. . | |

*Primary Examiner*—Randall Chin
*Attorney, Agent, or Firm*—Kenneth P. McKay

[57] ABSTRACT

A scraper is formed by an assembly of upright blades supported by a frame which is fixed over a waste receptacle. Cylindrical containers are scraped by rotation of the container over the assembly of upright blades, the waste products from the containers thereby being deposited in the waste receptacle, without handling. The mechanism may be further automated by the addition of a hand turning assembly or an electric motor assembly which rotates the assembly of upright blades within the container.

6 Claims, 5 Drawing Sheets

CONTAINER SIDE-WALL SCRAPER

BACKGROUND OF THE INVENTION

1. Field of the Invention

The invention relates to tools for scraping highly viscous substances from surfaces, particularly substances which remain on the inside of cylindrical containers after the substances are used. The scrapers help maximize the mount of product removed from the containers and, therefore, minimize waste products which are disposed into the environment.

2. Description of the Related Art

The current art shows a variety of scraping mechanisms, most of which are hand operated. The majority of the prior art falls into two categories. The first category is hand-held devices used to manually scrape the inside of the container. Secondly, there are motorized devices which rotate at significant speeds in order to scrape the inside of typically larger-wall surfaces, ranging from conduits and pipe to boilers.

A main drawback of the current art is that most of the devices require significant exposure of the human skin to the products being scraped because of local hand operation. This exposes the operator to hazards when the materials being handled are toxic or hazardous.

Another major drawback is that these devices are not conducive to ease of operation, especially where highly viscous or stiff materials are being scraped from the containers. A considerable amount of leverage is required without significant mechanical advantage when using these prior art inventions.

Another drawback is that the material being scraped by such devices must then be handled into a waste container. This accounts for a separate operation, in addition to the scraping operations.

The current invention addresses each of those concerns, and solves them accordingly, at little cost and great convenience for the user. The use of this invention also facilitates waste handling and the safety of the operator.

3. Prior Art

U.S. Pat. No. 5,494,352 (L'Estrange) dated Feb. 27, 1996 discloses a paint stirring blade with an upper handle section and a lower section with tapers and holes. This invention improves on the traditional means by which paint is stirred inside the can, but is plainly distinguishable from the present invention.

U.S. Pat. No. 5,345,642 (Faldetta) dated Sep. 13, 1994, comprises blade members for the purpose of scraping cylindrical containers clean of residual adhesive material. This invention is a hand tool utilizing only a single blade for the scraping process.

U.S. Pat. No. 4,469,445 (Wurtz) dated Sep. 4, 1984, discloses a wall scraping tool for mixing, drying or reacting dry materials, semi-dry materials, or viscous, pasty materials within the walls of a mixing container having a main shaft, and at least one support arm coupled to the main shaft. This invention relates to a mixing tool suited for use in a single or double shaft mixer.

U.S. Pat. No. 4,445,245 (Lu) dated May 1, 1984, discloses a miniature electric powered surface sweeper having a rotary brush element which is adapted to come into direct contact with the surface to be cleaned. This invention involves a surface cleaning mechanism that utilizes rotary elements.

U.S. Pat. No. 3,942,208 (Southard) dated Mar. 9, 1976, discloses a rotary cleaning device comprising a cup-shaped rotatable base member, a cylindrical resilient mounting received in the cup-shaped member and a plurality of elongated cleaning elements essentially in the form of wood screws mounted in the resilient mounting.

SUMMARY OF THE INVENTION

The objective of the present invention is to provide a means of scraping highly viscous material from the side walls of cylindrical container, such as cans or barrels.

A second objective is to minimize the amount of waste products which remain within these containers. This is important when toxic or hazardous materials are being removed from the containers before the containers are disposed of, for environmental considerations.

A third objective is to facilitate the direct removal of the waste into waste disposal containers, which are utilized in the current invention by means of their location immediately below the invention.

A fourth objective is to ensure the protection of the operator of such devices from skin exposure which results from such hand operations.

The invention, in its preferred embodiment, includes the aspects of design and use articulated above.

DETAILED DESCRIPTION OF THE PREFERRED EMBODIMENT

Figure 1:
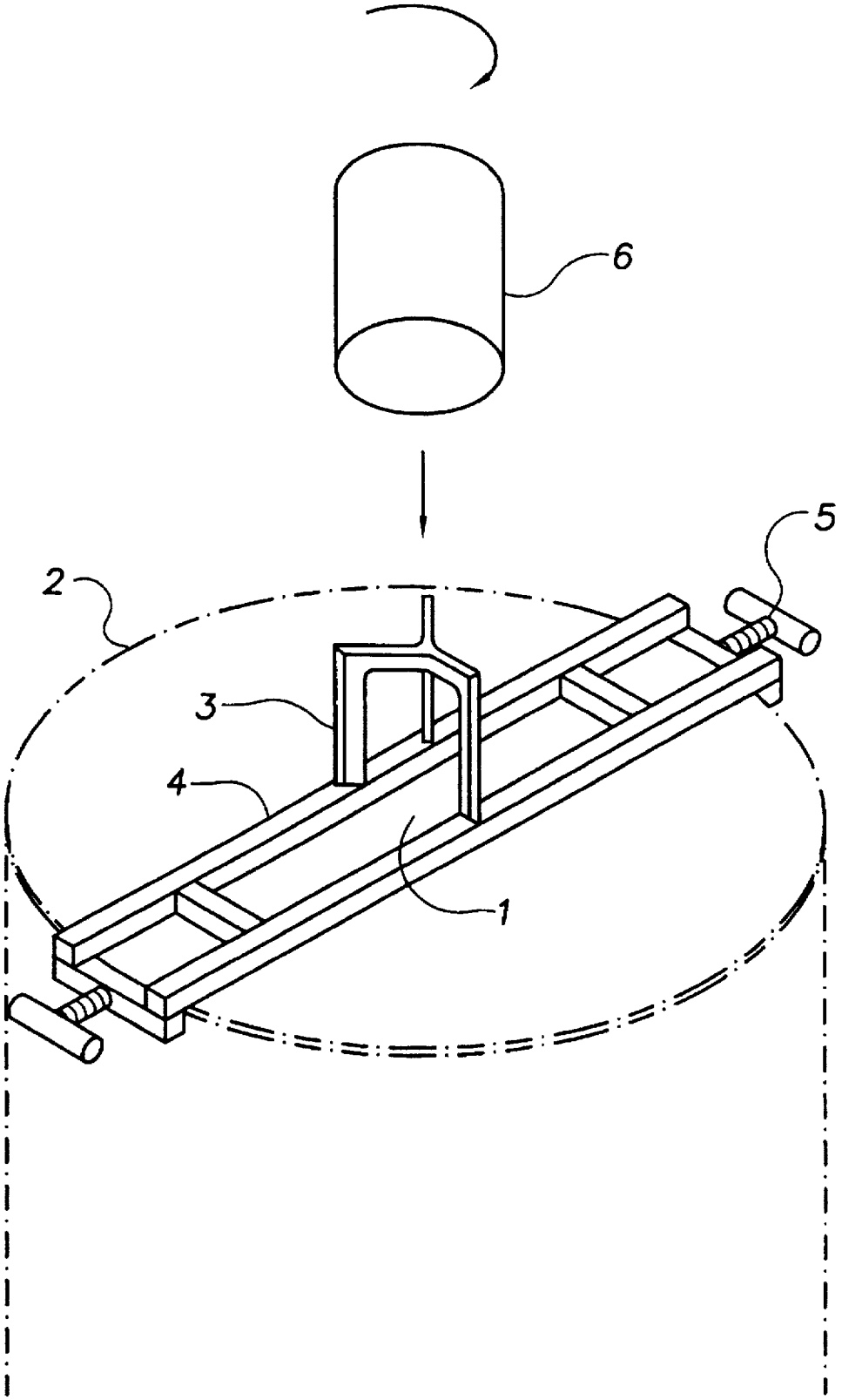
FIG. 1 is a perspective view of the Container Side-Wall Scraper.

The Container Side-Wall Scraper 1 is mounted on a waste collection receptacle 2 as shown in FIG. 1. The Container Side-Wall Scraper is comprised of the Scraper Vertical Blade Assembly 3, the Support Assembly 4 and the Clamping Means 5. A cylindrical container 6 is placed upside down over the Scraper Vertical Blade Assembly 3, and rotated in a clockwise direction, thereby scraping the side walls of the container, depositing any remaining products contained within the cylindrical container 6 into the waste collection receptacle 2.

Figure 2:
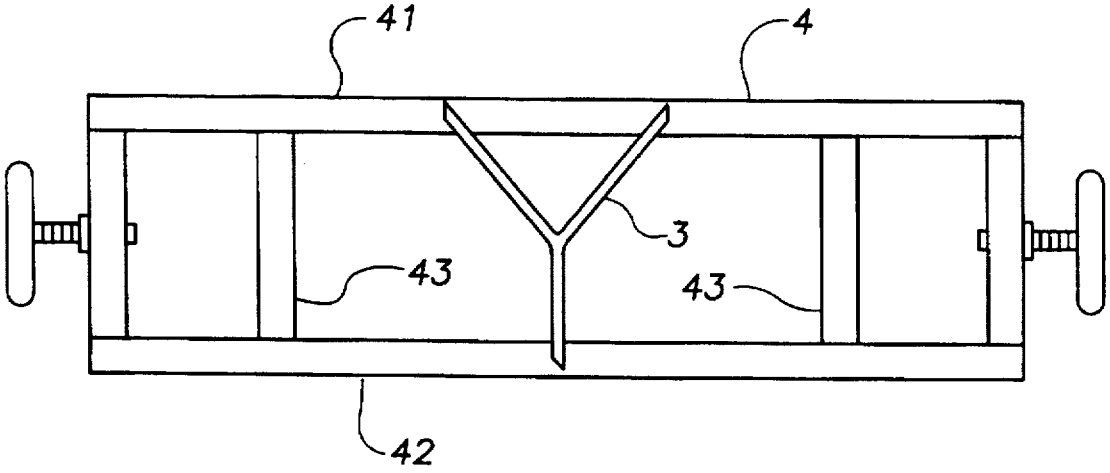
FIG. 2 is a plan view of the Container Side-Wall Scraper.

The Support Assembly 4 is the structural support for the Scraper Vertical Blade Assembly 3 as seen in FIG. 2. The Support Assembly 4 is comprised of the longitudinal support arms 41 and 42 which are designed to straddle the Scraper Vertical Blade Assembly 3 upon the Support Assembly 4 over the waste container 2. A multitude of transverse support arms 43 are used to laterally support and space the longitudinal support arms 41 and 42.

Figure 3:
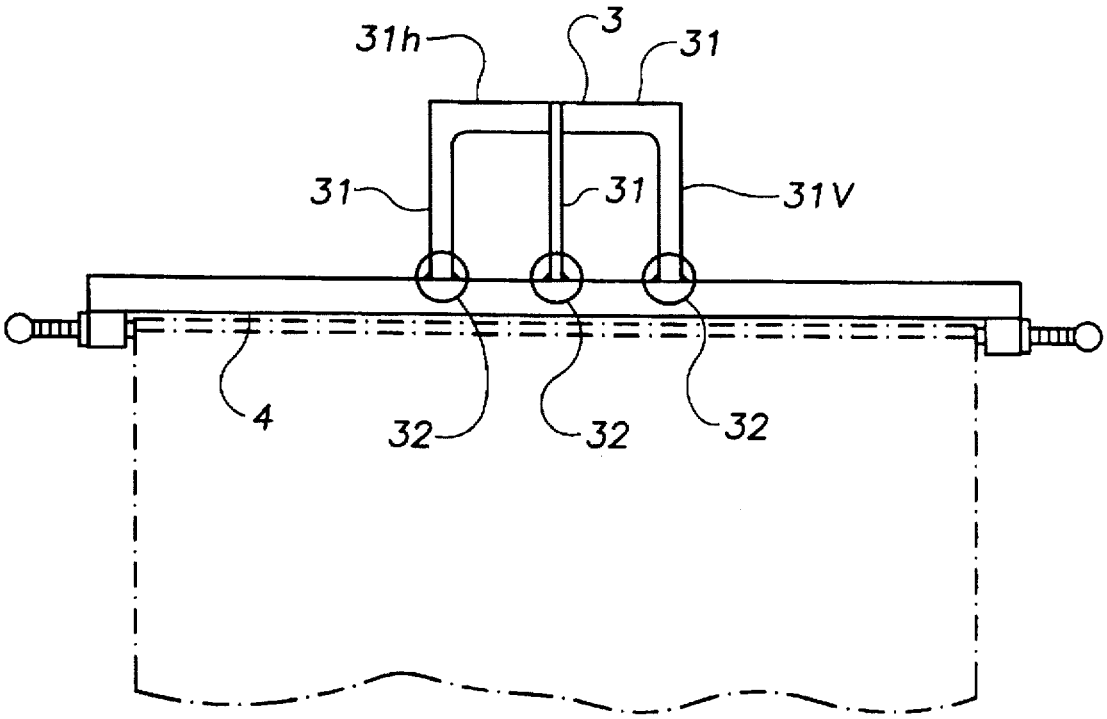
FIG. 3 is an elevation view of the Container Side-Wall Scraper.

FIG. 3 illustrates the Scraper Vertical Blade Assembly 3 which is comprised of three blades 31 each comprised of a vertical leg 31*v* and a horizontal leg 31*h*. The vertical legs 31*v* are each connected to the Support Assembly 4 by a vertical leg connecting means 32 at the intersection of the vertical leg 31*v* and the Support Assembly 4. The vertical leg connecting means 32 fixedly holds the vertical leg 31*v* to the Support Assembly 4.

Figure 4:
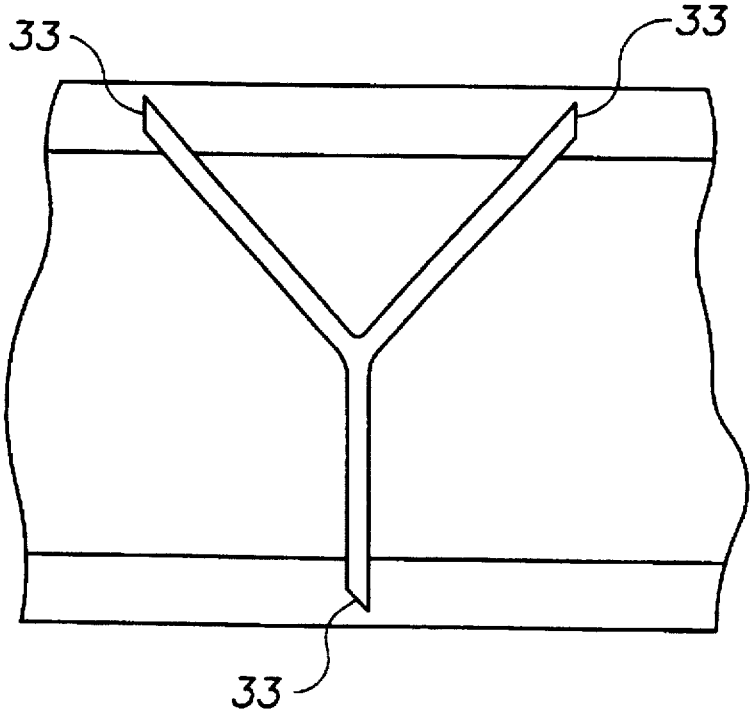
FIG. 4 is a plan view of the Container Side-Wall Scraper Vertical Blade Assembly, showing the blade cutting edges.
Figure 6:
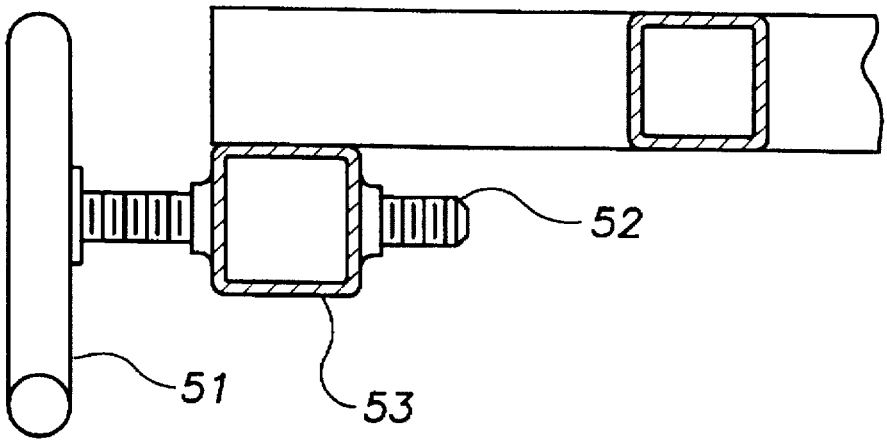
FIG. 6 is an elevation detail showing the Support Assembly Fastening Means comprising a screw and clamp device for the Container Side-Wall Scraper.

As in FIG. 4, each of the vertical legs 31*v* are fashioned such that the scraping face 33 is chamfered to facilitate the scraping of the containers. In the arrangement shown in FIG. 4, the Scraper Vertical Blade Assembly 3 is optimally employed as the container is rotated about the Scraper Vertical Blade Assembly 3 in a clockwise motion relative to the locus of the Scraper Vertical Blade Assembly 3.

Figure 5A:
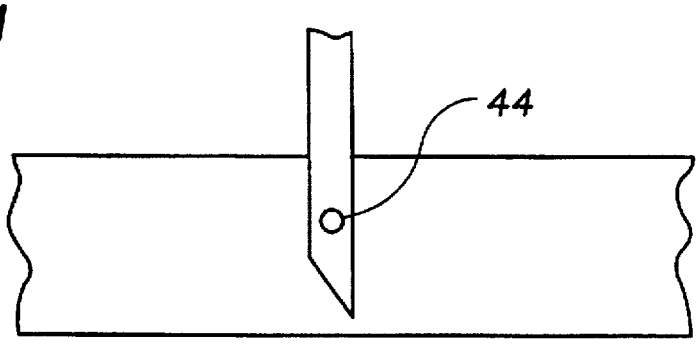
FIG. 5*a* shows a connection means for the Scraper Vertical Blade Assembly to the Support Assembly comprising dowels on the Support Assembly arms and depressions on the respective Scraper Vertical Blade Assembly blades.
Figure 5B:
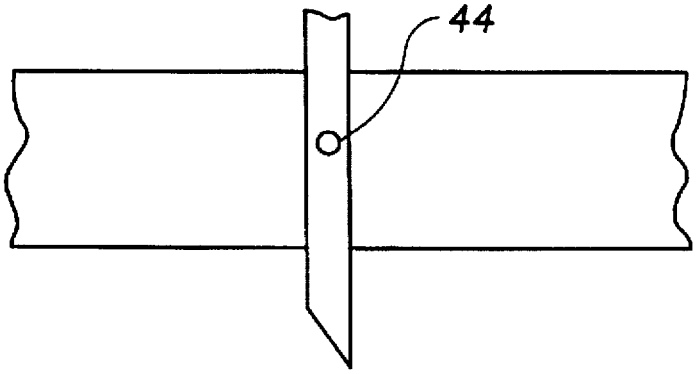
FIG. 5*b* shows a similar connection means, supporting a longer blade for scraping larger diameter containers than the blade shown in FIG. 5*a*.
Figure 5C:
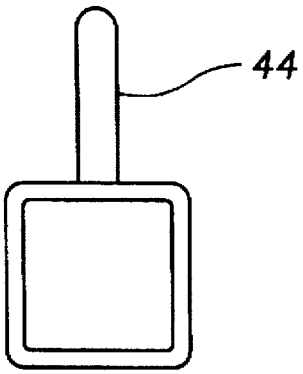
FIG. 5*c* shows the dowel on the support Assembly arm in elevation detail.

In a basic Scraper Vertical Blade Assembly 3, the vertical legs 31*v* are fixed rigidly to the longitudinal support arms 41 and 42 by the vertical leg connecting means 32. In an alternative embodiment, various diameter cylindrical containers can be accommodated by varying the length of the horizontal leg 31*h*. This can be accomplished as illustrated in FIG. 5. FIG. 5*a* shows a basic embodiment with a dowel and depressions means of connection whereby the longitudinal support arms 41 and 42 have respective dowels 44. In FIG. 5*b* a larger diameter container is used with the same Support Assembly 4 but utilizing a Scraper Vertical Blade Assembly 3 wherein the vertical legs 31*v* are constructed with a wider dimension than the basic embodiment, but with the depression in the Support Assembly relative location as compared to the Scraper Vertical Blade Assembly 3 locus. FIG. 5*c* shows a cross section of the longitudinal support arm 42 showing the dowel 44. The Scraper Vertical Blade Assembly 3 thereby becomes removable from the longitudinal support arm 42 as opposed to the fixed connection provided by the vertical leg connecting means 32 of the basic embodiment.

The invention also encompasses other means for varying the radius of the containers accommodated by such a device, including the means for adjusting the spacing of the support arms to allow the use of varying blade widths. This could also be accomplished by having adjustable width blades that expansively adjust with adjustments in longitudinal support arm spacing.

In the preferred embodiment, Clamping Means 5 is a screw type holding device comprised of a handle 51, threaded shaft 52 and housing 53. As the handle 51 is rotated, the threaded shaft 52 engages through the housing 53, holding the Support Assembly 4 rigidly above the waste collection receptacle 2.

Figure 7:
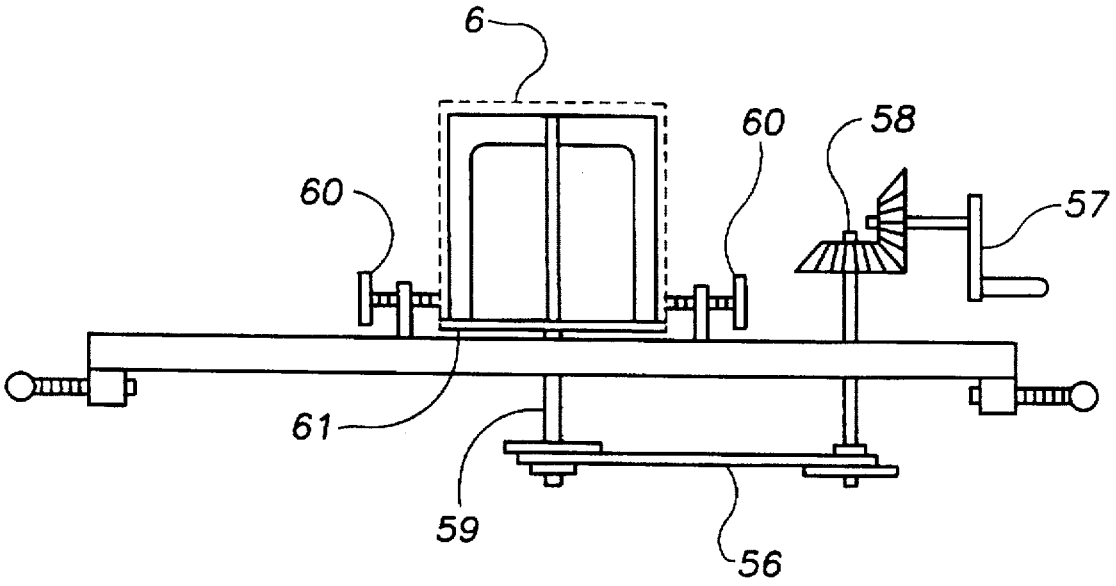
FIG. 7 is an elevation view showing an alternative device whereby the container is automatically scraped by means of a manual hand crank and gearing which rotates the Scraper Vertical Blade Assembly.

The basic embodiment, which is designed for ease of operation, convenience and low cost can be modified for frequent service applications by the embodiment illustrated in FIG. 7 whereby a hand turning assembly 56 is added to the Support Assembly 4. The Hand Turning Assembly 56 is comprised of the handle 57, the directional translation gearing 58, and the vertical drive shaftl 59 which connects the directional translation gearing 58 to the Scraper Vertical Blade Assembly 3. In this embodiment, the Scraper Vertical Blade Assembly 3 is rotated thereby scraping the cylindrical container 6. The container is held in place by a pair of anchoring means 60. To facilitate the rotation of the Scraper Vertical Blade Assembly 3 the Scraper Vertical Blade Assembly is connected by means of a rotating base 61, rather than the fixed connection means 32 in the basic embodiment. The rotating base 61 is rigidly fixed to the Scraper Vertical Blade Assembly 3 and the vertical drive shaft 59 and rotates with respect to the Support Assembly 4.

Figure 8:
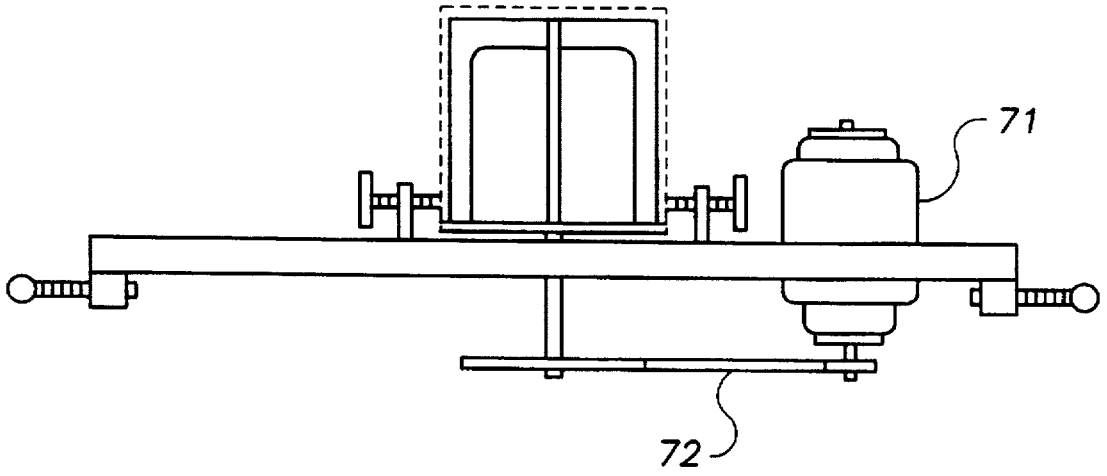
FIG. 8 is an elevation view showing an alternative device whereby the container is automatically scraped by means of an electric motor which rotates the Scraper Vertical Blade Assembly.

Greater operational effectiveness can be incorporated into the basic embodiment for volume operations by substitution of an electric motor, as shown in FIG. 8. Motor 71 is mounted on the support assembly. As a motor drive train, a reduction pulley and belt 72 acts to rotate the Scraper Vertical Blade Assembly and correspondingly reduce the speed of the rotation as compared to the output of the motor. The reduction pulley and belt is made up of a small pulley attached to the motor shaft, a large pulley attached to the vertical shaft connecting the Scraper Vertical Blade Assembly 3 and a belt connecting the small pulley and the large pulley. The output speed of the Scraper Vertical Blade Assembly 3 is determined by the speed of the electric motor multiplied by the reduction pulley-to-belt ratio.

What is claimed is:

1. A container side-wall scraper for removing material into a waste collection receptacle, comprising:

a. a scraper vertical blade assembly, comprising a multitude of inverted L-shaped blades, each blade having a vertical leg with a connection end and a horizontal leg with a focal end, all of said blades being joined to each other at respective focal ends whereby said horizontal legs radiate outward and form equal angles with respect to each other, with said vertical legs extending downward, and said vertical legs having an outwardly scraping face, whereby said scraping face is used to remove, by cutting, waste products from container side walls as a container is rotated with respect to said scraper vertical blade assembly;

b. a support assembly, comprising:

i) a multitude of parallel longitudinal support arms aligned over said waste receptacle;

ii) a means for fastening said vertical legs of said scraper vertical blade assembly to said longitudinal support arms;

iii) a multitude of transverse support arms joining and spatially aligning said longitudinal support arms; and, iv) a clamping means attached to said support assembly whereby said support assembly is fixedly but removably attached to said waste receptacle.

2. The container side-wall scraper of claim 1, wherein said means for fastening said vertical legs of said scraper vertical blade assembly to said longitudinal support arms comprises a permanent connection such that said vertical legs of said scraper vertical blade assembly are not removable from said longitudinal support arms.

3. The container side-wall scraper of claim 1, wherein said means for fastening said vertical legs of said scraper vertical blade assembly to said longitudinal support arms comprises a removable connection such that said vertical legs are attached to said longitudinal support arms in a removable manner thereby allowing varying sizes of scraper vertical blade assemblies to be utilized.

4. The container side-wall scraper of claim 1, wherein said clamping means further comprises a screw clamp attached to one of said transverse support arms at one end of said support assembly and a screw clamp attached at another of said transverse support arms at an opposing end of said support assembly.

5. The container side-wall scraper of claim 1, further comprising:

a. a container anchoring means whereby said container is rigidly fastened to said support assembly;

b. said means for fastening said vertical legs of said scraper vertical blade assembly to said longitudinal support arms comprising a rotating base wherein said scraper vertical blade assembly is capable of being rotated within a fixedly held container; and, c. a hand turning assembly for rotating said scraper vertical blade assembly within said fixedly held container, comprising:

(1) a vertical drive shaft fixedly connected to said means for fastening said vertical legs of said scraper vertical blade assembly to said longitudinal support arms;

(2) an L-shaped handle; and, (3) a set of directional translation gearing, rotatably linked to said handle and said vertical drive shaft whereby the turning of said handle turns said vertical drive shaft at a rotational speed equal to the rotational speed of said handle.

6. The container side-wall scraper of claim 1, further comprising:

a. a container anchoring means whereby said container is rigidly fastened to said support assembly;

b. said means for fastening said vertical legs of said scraper vertical blade assembly to said longitudinal support arms comprising a rotating base wherein said scraper vertical blade assembly is capable of being rotated within a fixedly held container; and, c. an electric motor having a motor drive shaft and a small pulley fixedly attached to said motor drive shaft;

d. a vertical drive shaft fixedly connected to said means for fastening said vertical legs of said scraper vertical blade assembly to said longitudinal support arms and having a large pulley fixedly attached to said vertical drive shaft;

e. a belt rotatably connecting said small pulley to said large pulley whereby the motor drive shaft rotates said vertical drive shaft at a speed reduced by a factor determined by the ratio of the diameter of the large pulley to the diameter of the small pulley.

* * * * *